US009603432B2

(12) United States Patent
Shahrur et al.

(10) Patent No.: US 9,603,432 B2
(45) Date of Patent: Mar. 28, 2017

(54) COSMETICS APPLICATOR

(71) Applicants: Josef Shahrur, Pardes Hana Karkur (IL); Ohad Henn, Ramat Gan (IL); BenZion Levi, Kibbutz Habonim (IL)

(72) Inventors: Josef Shahrur, Pardes Hana Karkur (IL); Ohad Henn, Ramat Gan (IL); BenZion Levi, Kibbutz Habonim (IL)

(73) Assignee: HOME SKINOVATIONS LTD. (IL)

( * ) Notice: Subject to any disclaimer, the term of this patent is extended or adjusted under 35 U.S.C. 154(b) by 6 days.

(21) Appl. No.: 14/661,326

(22) Filed: Mar. 18, 2015

(65) Prior Publication Data

US 2016/0270509 A1 Sep. 22, 2016

(51) Int. Cl.

| | |
|---|---|
| ***A45D 34/04*** | (2006.01) |
| ***A46B 9/02*** | (2006.01) |
| ***A46B 13/02*** | (2006.01) |
| ***A46B 13/04*** | (2006.01) |
| *A45D 34/00* | (2006.01) |

(52) U.S. Cl.

CPC ..... *A45D 34/042* (2013.01); *A46B 9/021* (2013.01); *A46B 13/023* (2013.01); *A46B 13/04* (2013.01); *A45D 2034/005* (2013.01); *A45D 2200/054* (2013.01); *A45D 2200/207* (2013.01)

(58) Field of Classification Search

CPC combination set(s) only.
See application file for complete search history.

(56) References Cited

U.S. PATENT DOCUMENTS 1,258,677 A * 3/1918 Haskell ..... A46B 11/0013 401/180
4,203,431 A * 5/1980 Abura ..... A61H 7/005 15/28
6,513,534 B1 * 2/2003 Sofer ..... A45D 24/28 132/112
7,503,715 B2 * 3/2009 Khubani ..... A46B 11/0013 401/205
7,695,207 B1 * 4/2010 Laghi ..... A46B 11/001 401/1
8,167,510 B2 * 5/2012 LaFlamme ..... A45D 34/04 401/188 R
8,308,390 B2 * 11/2012 Kao ..... A46B 11/0062 401/289
2009/0188528 A1 7/2009 Junkins
2014/0007897 A1 1/2014 Huang

FOREIGN PATENT DOCUMENTS

WO 2016/010607 1/2016

OTHER PUBLICATIONS

PCT Search Report and Written Opinion, PCT/IB2016/051529, Jun. 30, 2016.

* cited by examiner

*Primary Examiner* — David Walczak

(74) *Attorney, Agent, or Firm* — Dekel Patent Ltd.; David Klein

(57) ABSTRACT

A cosmetics applicator includes a housing including a movable brush head, and a motion actuator operative to move the brush head in a vibrational motion, a rotational motion or a combination thereof. A cartridge contains a cosmetic to be dispensed. A dispensing actuator is operative to dispense the cosmetic out of the cartridge. The cartridge includes an applicator probe that extends forward to a center of the brush head and the cosmetic is dispensed out of a distal tip of the probe.

13 Claims, 3 Drawing Sheets

COSMETICS APPLICATOR

FIELD OF THE INVENTION

The present invention relates generally to applicators for applying cosmetics and particularly to a cosmetics applicator with enhanced application capability.

BACKGROUND OF THE INVENTION

Cosmetics refer to a group of substances or mixtures of materials that are applied to portions of a body to alter an appearance, provide a fragrance and/or to protect skin and hair. Cosmetics include, without limitation, skin-care creams, lotions, powders, perfumes, lipsticks, fingernail and toenail polishes, eye and facial makeup, hair colors, hair sprays and gels, deodorants, bath oils, bubble baths, bath salts, butters and many other types of products.

A number of cosmetics, especially those cosmetics referred to as "make-up", are applied using multi-use or single-use brushes, sponges, or pad applicators. A facial cosmetic system often includes a loose applicator that is stored within a cosmetics case (compact) along with a cosmetic. In these facial cosmetic systems, the applicator often becomes coated or soiled with the cosmetic while the compact is carried in a purse, backpack or pocket. Further, these applicators tend to get lost or separated from the compact while being carried around or during use.

Devices exist for applying cosmetics to surfaces. Such devices usually include a handle and an applicator head having a brush or sponge. For example, in the medical industry, applicators are employed for applying medicinal products, such as ointments, to portions of the body. In the cosmetics and personal care industries, applicators are used to apply lipstick, lip balm, skin creams, lotions, and other cosmetic products to portions of the body.

Throughout the specification and claims, the terms "medicinal substance" and "cosmetic" are used interchangeably and the terms encompass cosmetics, drugs and other medicinal products.

Many cosmetic and personal care products are best applied in a rotational fashion, such as for example, buffing with foundation, blush, rouge, other loose powders, etc. Additionally, some product applications may benefit from oscillating the applicator head during application. For example, in the entertainment industry some makeup effects may require rotational and/or oscillation application.

SUMMARY OF THE INVENTION

The present invention seeks to provide an improved cosmetics applicator with enhanced application capability, as is described more in detail hereinbelow. In particular, the present invention seeks to provide a simplified and less expensive.

In one embodiment, the applicator includes an applicator brush operatively connected to a motion actuator (e.g., electric motor) so that the brush can move in an oscillatory motion (or other vibrational motion), a rotational motion or a combination thereof. All motions are imparted to the brush by a single motion actuator.

A cartridge, which may or may not be disposable, contains the cosmetic to be dispensed plus the dispensing actuator, such as a pump. Without limitation, the dispensing and brush head movement can be coordinated with each other. Examples of possible modes of operation include, without limitation: vibration alone, vibration combined with pumping, rotation alone, rotation combined with pumping, combination of vibration and rotation with or without pumping. One embodiment of accomplishing this is described below, including a planetary gear and one-way gear system.

A cartridge contains the cosmetic to be dispensed plus the dispensing actuator, such as a pump. In other embodiments, the pump is separate from the cartridge. The cartridge is inserted at the rear of the brush head and has an applicator probe that extends forward to the center of the brush. The applicator probe has a normally closed discharge opening at its distal tip. The distal tip serves as a one-way valve, which opens by internal pressure to allow application of the cosmetic but when closed seals the probe so that no material leaks out. Alternatively, the distal tip may have a compressible nipple that serves as a one-way valve: when pressed against a surface the nipple discharge opening opens to allow application of the cosmetic but when not pressed it seals the probe so that no material leaks out. The cartridge or parts thereof may or may not be disposable.

The bristles of the brush head may be structured and/or formed in a pattern for enhanced application of the substance. For example, the bristles may form a spiral pattern, which may be advantageous in spreading foamed or gel substances. The bristles may have tapered ends (slanted towards or away from the center of the brush head). The bristles may have different heights or staggered heights for enhancing application of certain substances.

There is thus provided in accordance with a non-limiting embodiment of the present invention a cosmetics applicator including a housing including a movable brush head, a motion actuator operative to move the brush head in a vibrational motion, a rotational motion or a combination thereof, a cartridge containing a cosmetic to be dispensed, and a dispensing actuator operative to dispense the cosmetic out of the cartridge, and the cartridge includes an applicator probe that extends forward to a center of the brush head and the cosmetic is dispensed out of a distal tip of the probe.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 1:
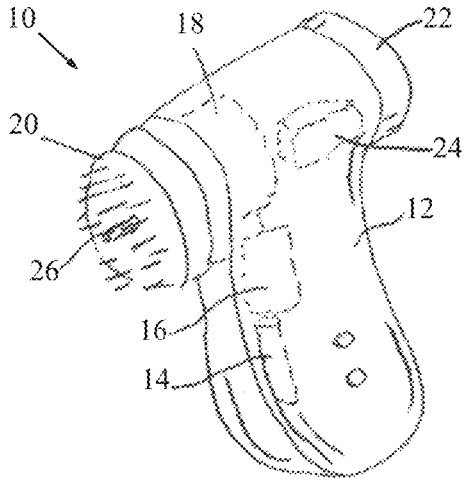
FIG. 1 is a simplified illustration of a cosmetics applicator, constructed and operative in accordance with an embodiment of the present invention.

Reference is now made to FIG. 1, which illustrates a cosmetics applicator 10, constructed and operative in accordance with a non-limiting embodiment of the present invention.

Cosmetics applicator 10 includes a housing or handle 12, in which are housed one or more batteries 14 (e.g., rechargeable) and a controller 16 (control circuitry which may work in a closed loop with sensors). The controller 16 controls operation of a motion actuator 18 (e.g., electric motor) operative to move a brush head 20.

In one embodiment, motion actuator 18 moves brush head 20 in an oscillatory motion (or other vibrational motion), a rotational motion or a combination thereof. All motions can be imparted to the brush by a single motion actuator or by a motion actuator that comprises different components for different types of motion (rotation, translation, combination thereof). One non-limiting embodiment of an actuator is described below with reference to FIGS. 5A-5C.

Figure 2:
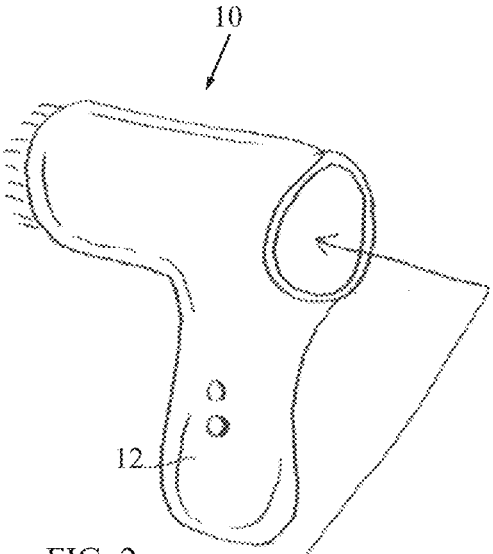
FIG. 2 is a simplified illustration of the applicator, showing a cosmetics cartridge inserted at the rear of the applicator to the rear of a brush head, in accordance with an embodiment of the present invention.

A cartridge 22 contains the cosmetic 23 to be dispensed. In one embodiment, a dispensing actuator 24 is disposed in the housing 12 of cosmetics applicator 10 and dispenses the substance out of cartridge 22 (as seen in broken lines in FIG. 1). In another embodiment, cartridge 22 contains the cosmetic 23 to be dispensed plus the dispensing actuator 24 (as seen in broken lines in FIG. 2).

Cartridge 22 is inserted in an opening at the rear of housing 12 (FIG. 2) (or any other portion of the housing, not just the rear) and has an applicator probe 26 that extends forward to the center of the brush head 20 (as seen in FIG. 1). In a preferred embodiment, the substance is not drawn to the bristles of the brush head by wicking or capillary action and is not injected through hollow bristles; rather the substance exits the tip of the probe 26 at the end of the bristles and is deposited on the surface (e.g., skin, hair or nails), and is spread by the action of the moving brush head 20. (The substance can alternatively be applied by wicking or capillary action or injection through hollow bristles.)

Figure 3:
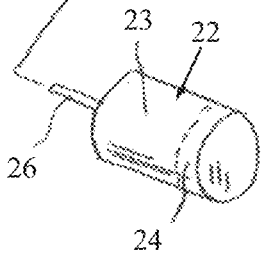
FIG. 3 is a simplified sectional illustration of a dispenser probe of the cartridge, the section cutting through the axial length of the probe.
Figure 3:
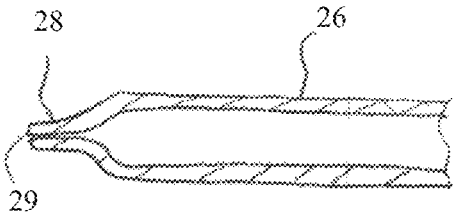
Figure 4:
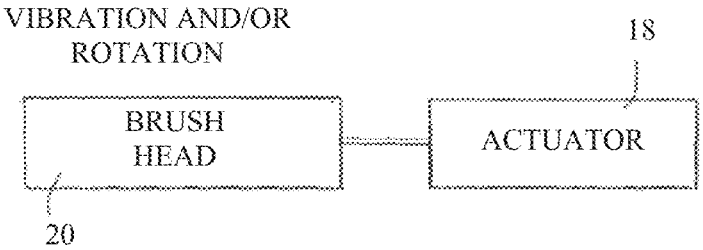
FIG. 4 is a simplified block diagram of the brush head connected to an actuator.

As seen in FIG. 3, applicator probe 26 has a nipple 28 with a normally closed discharge opening 29 at its distal tip. The distal tip of nipple 28 serves as a one-way valve, which opens by internal pressure to allow application of the cosmetic but when closed seals the probe so that no material leaks out. Alternatively, the nipple may be a compressible nipple that serves as a one-way valve: when pressed against a surface the nipple discharge opening 29 opens to allow application of the cosmetic but when not pressed it seals the probe so that no material leaks out. Cartridge 22 or parts thereof may or may not be disposable.

Without limitation, the dispensing and brush head movement can be coordinated with each other by means of controller 16. Controller 16 is operatively connected to motion actuator 18 and/or dispensing actuator 24. Examples of possible modes of operation include, without limitation: vibration alone, vibration combined with pumping, rotation alone, rotation combined with pumping, combination of vibration and rotation with or without pumping.

The cosmetic 23 may include, without limitation, a composition for applying to: the nails; the skin; keratinous fibers, in particular the eyelashes, the eyebrows, or the hair; or the lips, e.g. a mascara; an eyeliner; a nail varnish; a lipstick; a lip gloss; a foundation; a blusher; an eye shadow; an eye-contour concealer; an under-eye dark-circle concealer; a self-tanning agent; a sun-screen; a care product for the eyebrows, the eyelids, the lips, the skin of the face, the skin of the cheeks, the nails, the hands, or the feet, a blemish concealer; an anti-wrinkle cream; an under-eye puffiness concealer; a body lotion; a root-treatment composition, in particular for encouraging hair growth, or a massage composition for the face or the body, among others. The composition may contain pigments, fibers, glitter, or other macroscopic elements. The composition may present magnetic properties, where appropriate. The composition may be in powder, paste, gel or liquid form.

The dispensing actuator 24 may include, without limitation, a peristaltic pump, a plunger pump, a gear pump, a gravity pump, radial flow pump, axial flow pump, a centrifugal pump, or a pinch pump, among others.

Figure 5A:
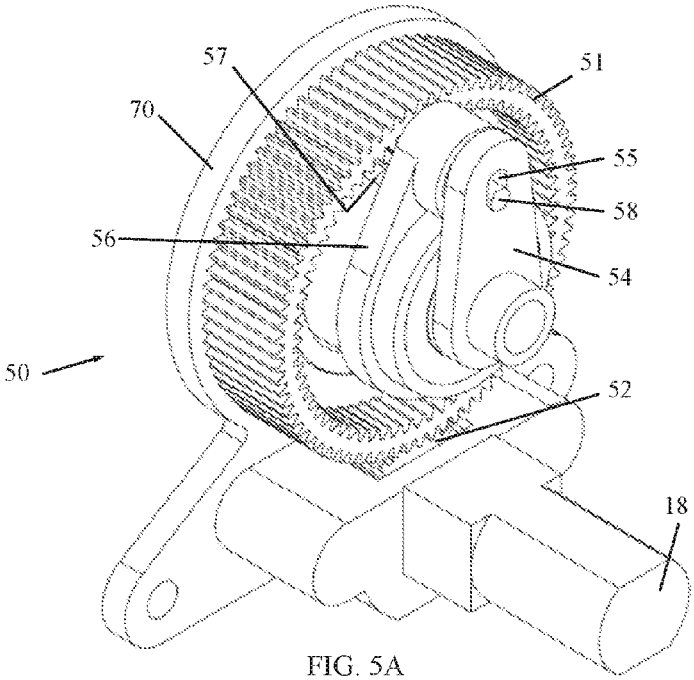
FIGS. 5A, 5B and 5C are simplified pictorial, exploded and sectional illustrations, respectively, of a planetary gear system for imparting rotational and vibrational movement to the brush head, in accordance with an embodiment of the present invention.
Figure 5B:
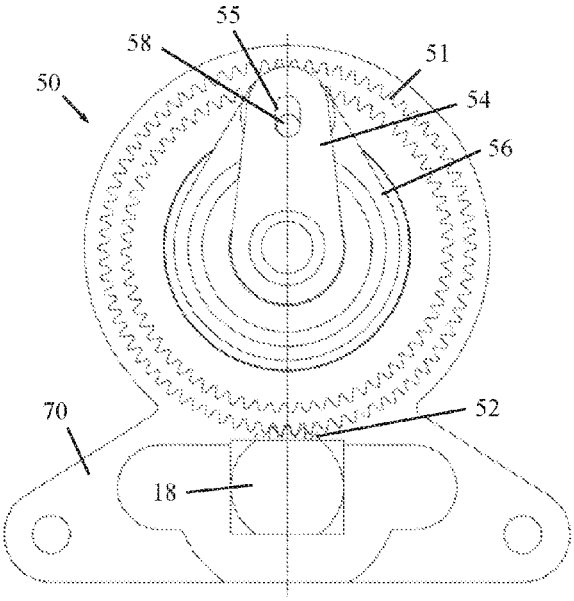
Figure 5C:
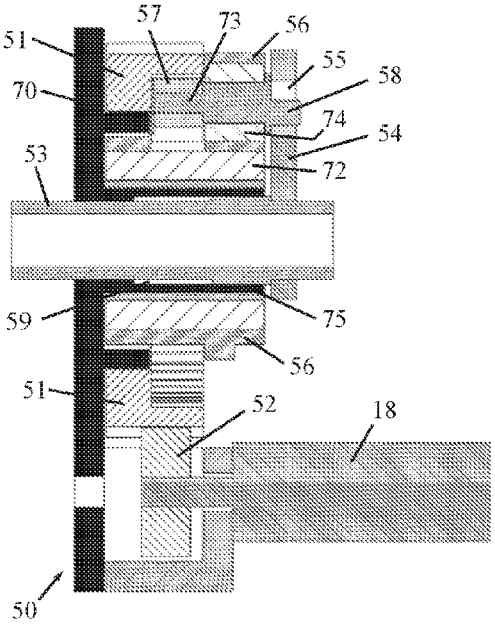

Reference is now made to FIGS. 5A, 5B and 5C, which illustrate a planetary gear system 50 for imparting rotational and vibrational movement to the brush head (not shown in these figures), in accordance with an embodiment of the present invention.

The planetary gear system 50 includes an outer gear 51, which has gear teeth on its outer contour for meshing with a spur gear 52 rotated by the motion actuator 18 (FIGS. 5B and 5C). Outer gear 51 rotates by means of a bearing 59 mounted on a portion 70 of housing 12. A rotatable shaft 53 passes through the center of outer gear 51 and through portion 70 of housing 12. Applicator probe 26 (not shown here) passes through shaft 53. One end of shaft 53 is connected to the brush head 20 (not shown in the figures). A rigid arm 54 is mounted on the opposite end of shaft 53. Rigid arm 54 is formed with a channel 55. A hub platform 56 is mounted on a stationary shaft 75 mounted over shaft 53 (not far from arm 54) by means of a one-way bearing 72, which permits hub platform 56 to rotate in one direction only. A planetary gear 57 is mounted on a gear shaft 73, which is rotatingly mounted on hub platform 56 by means of a one-way bearing 74, which permits planetary gear 57 to rotate in one direction only. An eccentric shaft 58 protrudes from planetary gear 57 and is constrained to travel in channel 55. The eccentric shaft 58 of planetary gear 57 can oscillate in channel 55 as the outer gear 51 rotates, which causes vibration of the brush head; or the hub platform 56 can rotate together with the outer gear 51 (with planetary gear 57 travelling together with the hub platform 56), which causes rotation of the brush head, as is now explained.

The motor (motion actuator 18), via spur gear 52, can turn the outer gear 51 in a first direction (e.g., clockwise), which is the direction in which the one-way bearing 72 does NOT allow hub platform 56 to rotate, and is the direction in which the one-way bearing 74 permits planetary gear 57 to rotate. When the outer gear 51 turns in the first direction, hub platform 56 does not rotate, but planetary gear 57 rotates and eccentric shaft 58 oscillates in channel 55 (travels from one end of the channel to the other, back and forth) as the outer gear 51 rotates. This causes vibration of the brush head.

The motor (motion actuator 18), via spur gear 52, can turn the outer gear 51 in a second direction (e.g., counterclockwise), which is the direction in which the one-way bearing 72 permits hub platform 56 to rotate, and is the direction in which the one-way bearing 74 does NOT allow planetary gear 57 to rotate. When the outer gear 51 turns in the second direction, hub platform 56 also rotates with the outer gear 51, but planetary gear 57 does not rotate about gear shaft 73. Instead planetary gear 57 moves around shaft 53 together with the rotation of hub platform 56 (eccentric shaft 58 of planetary gear 57 does not oscillate in channel 55 as the outer gear 51 rotates). This causes rotation of the brush head.

Alternatively, there is no one-way bearing 74, so that planetary gear 57 is always free to rotate about gear shaft 73. In this case, in the second direction, planetary gear 57 moves around shaft 53 together with the rotation of hub platform 56 and eccentric shaft 58 of planetary gear 57 also oscillates in channel 55 as the outer gear 51 rotates. This causes both vibration and rotation of the brush head.

The embodiment of FIGS. 5A-5C is only one way of causing rotational and vibrational motion of the brush head with a single motor, and the invention is not limited to this structure.

Figure 6:
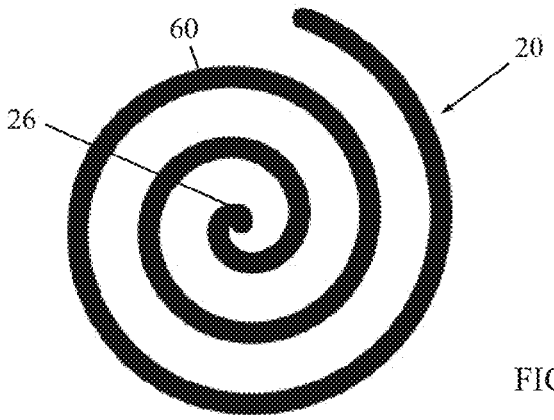
FIG. 6 is a simplified illustration of a pattern of bristles of the brush head of the applicator, in accordance with an embodiment of the present invention.

Reference is now made to FIG. 6, which illustrates a pattern of bristles 60 of brush head 20, in accordance with an embodiment of the present invention. The bristles 60 may be structured and/or formed in a spiral pattern, which may be advantageous in spreading foamed or gel substances. Other patterns may also be employed.

Figure 7A:
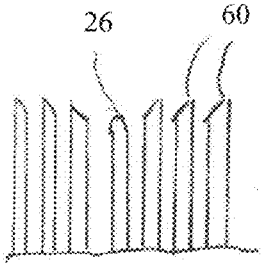
FIGS. 7A, 7B and 7C are simplified illustrations of bristles for the brush head, in accordance with different embodiments of the present invention.
Figure 7B:
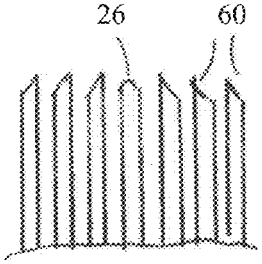
Figure 7C:
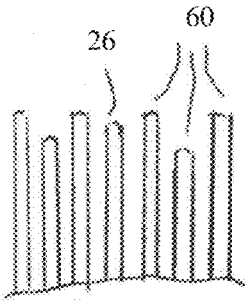

Reference is now made to FIGS. 7A, 7B and 7C. Bristles 60 may have tapered ends slanted towards (FIG. 7A) or away from (FIG. 7B) the center of the brush head. The bristles may have different heights or staggered heights for enhancing application of certain substances (FIG. 7C).

What is claimed is:

1. A cosmetics applicator comprising:

a housing comprising a movable brush head;

a motion actuator operative to move said brush head in a combination of vibrational motion and rotational motion;

a cartridge containing a cosmetic to be dispensed; and a dispensing actuator operative to dispense the cosmetic out of said cartridge, wherein said cartridge comprises an applicator probe that extends forward to a center of said brush head and the cosmetic is dispensed out of a distal tip of said probe.

2. The cosmetics applicator according to claim 1, wherein said cartridge is inserted at a rear opening of said housing.

3. The cosmetics applicator according to claim 1, wherein said dispensing actuator is disposed in said housing.

4. The cosmetics applicator according to claim 1, wherein said dispensing actuator is disposed in said cartridge.

5. The cosmetics applicator according to claim 1, wherein said probe comprises a compressible nipple with a normally closed discharge opening at its distal tip, wherein said nipple serves as a one-way valve.

6. The cosmetics applicator according to claim 1, further comprising a controller operatively connected to said motion actuator.

7. The cosmetics applicator according to claim 1, further comprising a controller operatively connected to at least one of said motion actuator and said dispensing actuator.

8. The cosmetics applicator according to claim 1, wherein said motion actuator is operative to move said brush head through a one-way gear system.

9. The cosmetics applicator according to claim 8, wherein said one-way gear system comprises:

a planetary gear system comprising an outer gear, which has gear teeth on its outer contour for meshing with a spur gear rotated by said motion actuator;

a rotatable shaft that passes through a center of said outer gear and through a portion of said housing, said applicator probe passing through said rotatable shaft, wherein one end of said rotatable shaft is connected to said brush head and a rigid arm is mounted on an opposite end of said rotatable shaft, said rigid arm being formed with a channel;

a hub platform connected to said rotatable shaft by means of a first one-way bearing, which permits said hub platform to rotate in one direction only;

a planetary gear mounted on a gear shaft, which is rotatingly mounted on said hub platform by means of a second one-way bearing, which permits said planetary gear to rotate in one direction only; and an eccentric shaft that protrudes from said planetary gear and is constrained to travel in said channel;

wherein said eccentric shaft can oscillate in said channel as said outer gear rotates, which causes vibration of said brush head; or said hub platform can rotate together with said outer gear, with said planetary gear travelling together with said hub platform, which causes rotation of said brush head.

10. The cosmetics applicator according to claim 1, wherein said brush head comprises bristles in a spiral pattern.

11. The cosmetics applicator according to claim 1, wherein said brush head comprises bristles with tapered ends slanted towards a center of said brush head.

12. The cosmetics applicator according to claim 1, wherein said brush head comprises bristles with tapered ends slanted away from a center of said brush head.

13. The cosmetics applicator according to claim 1, wherein said brush head comprises bristles of different heights.

* * * * *